US010024344B2

(12) United States Patent
Ognibene

(10) Patent No.: US 10,024,344 B2
(45) Date of Patent: Jul. 17, 2018

(54) HYDRAULIC PISTON-CYLINDER GROUP

(71) Applicant: OGNIBENE POWER S.P.A., Reggio Emilia (IT)

(72) Inventor: Claudio Ognibene, Reggio Emilia (IT)

(73) Assignee: OGNIBENE POWER S.P.A., Reggio Emilia (RE) (IT)

( * ) Notice: Subject to any disclaimer, the term of this patent is extended or adjusted under 35 U.S.C. 154(b) by 469 days.

(21) Appl. No.: 14/710,455

(22) Filed: May 12, 2015

(65) Prior Publication Data

US 2015/0330420 A1 Nov. 19, 2015

(30) Foreign Application Priority Data

May 15, 2014 (IT) ..... RE2014A0050

(51) Int. Cl.
*F15B 15/22* (2006.01)
*F15B 15/14* (2006.01)

(52) U.S. Cl.
CPC ..... *F15B 15/223* (2013.01); *F15B 15/1452* (2013.01); *F15B 15/224* (2013.01)

(58) Field of Classification Search
CPC .... E21B 21/08; F15B 15/1452; F15B 15/224; F15B 15/226; F15B 2211/853
See application file for complete search history.

(56) References Cited

U.S. PATENT DOCUMENTS 3,364,675 A 1/1968 Dorer
3,592,106 A * 7/1971 Baughman ..... F15B 15/224 91/409
4,207,800 A * 6/1980 Homuth ..... F15B 15/224 91/26
2013/0139508 A1 6/2013 Marlin et al.

FOREIGN PATENT DOCUMENTS

DE 29700256 U1 3/1997
GB 427780 A 4/1935

* cited by examiner

*Primary Examiner* — F. Daniel Lopez
*Assistant Examiner* — Abiy Teka
(74) *Attorney, Agent, or Firm* — Volpe and Koenig, P.C.

(57) ABSTRACT

A hydraulic piston-cylinder group includes a cylinder containing a piston which defines internally of the cylinder at least a first and a second chamber, respectively communicating with a first and a second inlet/outlet hole of a pressurized fluid for actuating the piston between a first and a second position. The piston has a gully defined by a bottom wall, a first lateral wall that is proximal to the first free end, and a second lateral wall distal relative to the first free end, the first and second lateral walls serving as first and second abutments for the piston ring, the gully communicating through at least a passage with the first chamber. A depression is provided on the contact surface between the second lateral wall of the gully and the piston ring, the depression enables a controlled bleeding of the pressurized fluid between the piston ring and the second lateral wall.

9 Claims, 4 Drawing Sheets

HYDRAULIC PISTON-CYLINDER GROUP

FIELD OF THE INVENTION

The present invention relates to a hydraulic piston-cylinder group.

In particular the invention relates to a silenced hydraulic piston-cylinder group.

BACKGROUND

U.S. Pat. No. 3,592,106 describes a hydraulic piston-cylinder group. The cylinder is equipped with a channel in which a piston ring is located, positioned between the cylinder-piston sealing elements and the free end of the piston. The bottom of the channel affords a radial hole that places the channel in communication with the free end of the cylinder. The free end of the cylinder is subject to an overpressure that slows the motion of the cylinder when the cylinder is proximal to an end-run position and the piston ring moves beyond the outlet hole of the pressurized fluid that actuates the cylinder.

The end of the cylinder exhibits a further radial hole that puts the free end of the cylinder into communication with an annular chamber formed between the piston-cylinder sealing elements of known type and the piston ring. The further hole enables a controlled outflow of the fluid trapped in front of the free end of the piston towards the outlet hole.

The transit of fluid through the further passage generates a noise of the cylinder-piston group when in a deceleration step and proximal to the end-run position.

SUMMARY

An aim of the present invention is to provide a cylinder-piston group exhibiting a reduced noise level when the piston is in a decelerating step proximal to the end-run position.

This and other aims are attained by a cylinder-piston group exhibiting the technical characteristics described in the claims.

BRIEF DESCRIPTION OF THE DRAWINGS

Further characteristics and advantages of the invention will better emerge from the detailed description of a preferred but not exclusive embodiment, provided by way of non-limiting example in the accompanying figures of the drawings, in which.

DETAILED DESCRIPTION OF THE PREFERRED EMBODIMENTS

Figure 1:
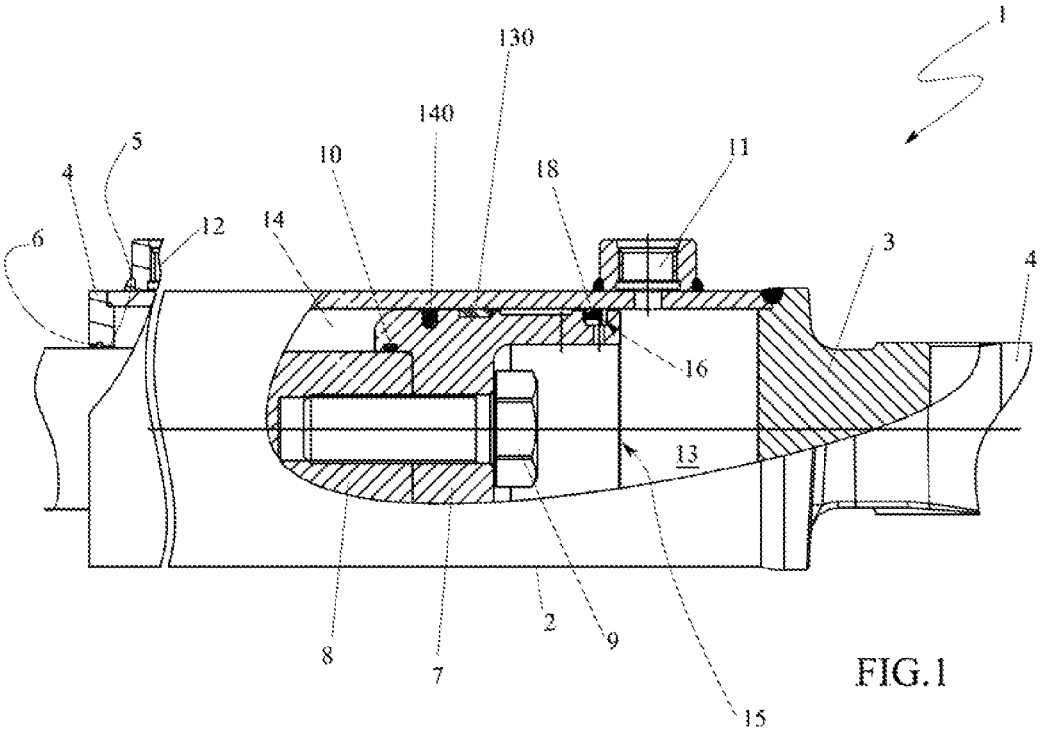
FIG. 1 is a partial view, partially sectioned, of the cylinder-endrun group, when the piston is distal from a piston end-run position.

The figures illustrated a cylinder-piston group which is denoted in its entirety by reference number 1.

The hydraulic cylinder-piston group 1 comprises a cylinder 2 closed by a first head 3 and a second head 4. The first head 3 can exhibit conventional support and constraining means of the group 1, such as for example a spherical joint, a bushing, or a conical pin.

In the illustrated example the second head 4 instead affords a hole 5, in which a rod 8 is slidingly inserted and fixed to a piston 7 housed in the cylinder 2. The hole 5 is equipped with known sealing elements 6 which act on the surface of the rod 8. The rod 8 is instead fixed by known means at one end to the piston 7 using a through screw 9, while between the rod and the piston further sealing elements 10 are provided.

As can be observed in FIG. 1, the piston 7 defines internally of the cylinder (together with the heads) a first chamber 13 and a second chamber 14, respectively in communication with a first hole 11 and a second hole 12 for inlet/outlet of a pressurized fluid for actuating the piston internally of the cylinder 2.

Figure 3:
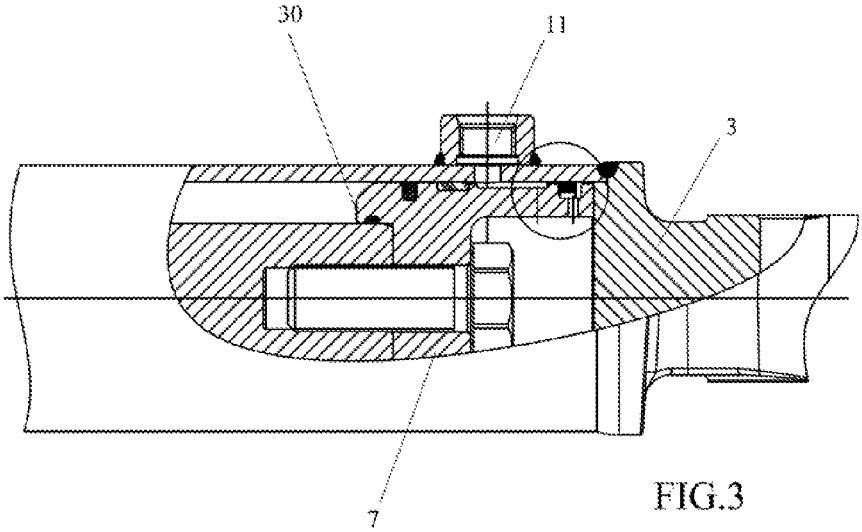
FIG. 3 is a partial view, partially sectioned, of the cylinder of FIG. 1, when the piston is at an end-run position, upon completion of a piston stroke.
Figure 4:
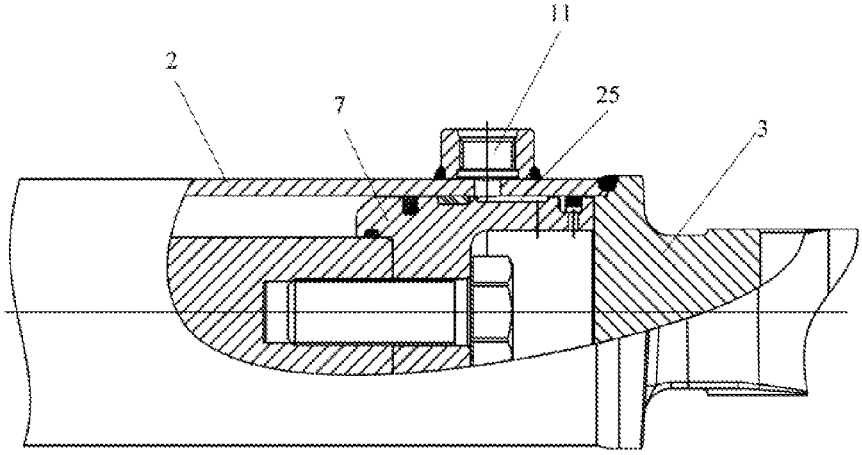
FIG. 4 is a partial view, partially sectioned, of the cylinder of FIG. 1, when the piston is in a re-departure step.

The piston is thus mobile between a first (FIGS. 3 and 4) and a second end-run position (not shown). When a pressurized fluid (preferably oil-based) is supplied through the first hole 11 to the first chamber 13, the piston 7 (and consequently the rod 8) moves towards the left in FIG. 1, while when pressurized fluid is supplied through the second hole 12 into the second chamber 14, the piston 7 moves towards the right in FIG. 1. Obviously, when pressurized fluid is supplied through one of the holes 11, 12, it is necessary to permit an outflow of fluid through the other hole, otherwise the piston would be unable to move in any direction.

Figure 5:
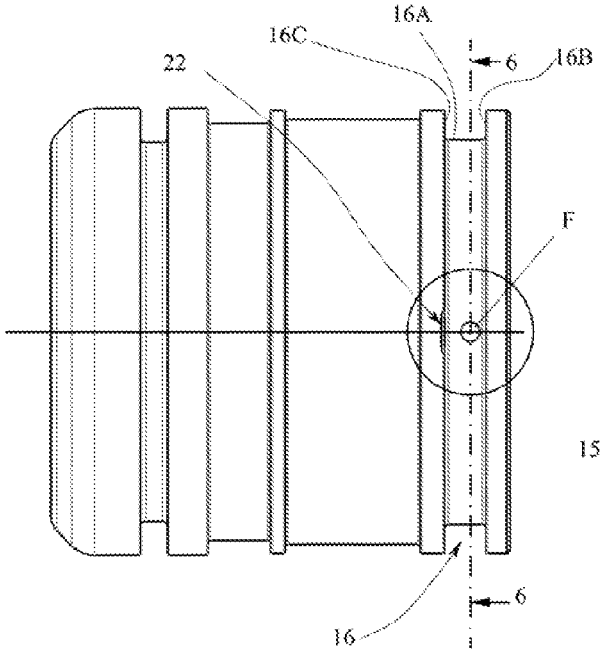
FIG. 5 is a lateral view of the piston without sealing elements.
Figure 6:
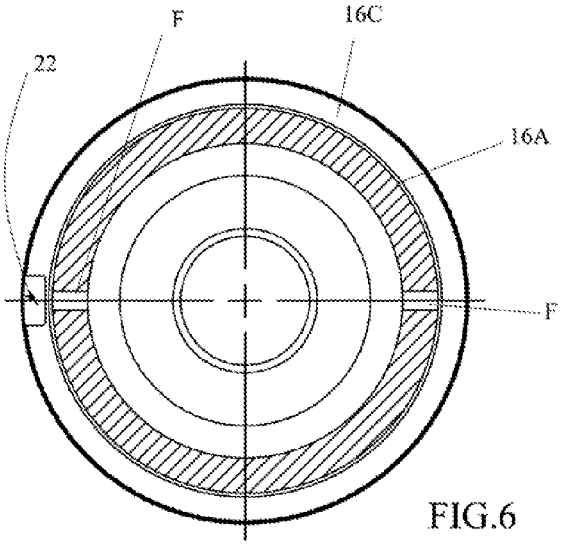
FIG. 6 is a section along line 6-6 of FIG. 6.

The external surface of the piston 7 exhibits annular housings of known type for a guide slider 130 (optional) and for a main sealing ring 140. Furthermore, a gully 16 is fashioned between the main sealing ring 140 and a first free end 15 of the piston facing the first chamber 13, which gully 16 is clearly shown in FIG. 3A (also visible in FIG. 5).

The gully 16 is defined by a bottom wall 16A, a first lateral wall 16B proximal to the first free end 15 of the cylinder, and a second lateral wall 16C distal relative to the first free end 15 and parallel to the first lateral wall 16B.

A piston ring 18 is located internally of the gully 16, which piston ring 18 in cross-section (FIG. 3A) exhibits a rectangular (or square) shape and a width S that is smaller than the width A of the gully 16. The piston ring 18 is thus axially mobile internally of the first gully. It should be noted that in the present description the term "piston ring" is used to define a split elastic ring (or band) housed internally of the gully 16.

The movement of the piston ring is limited by the lateral walls 16B and 16C of the gully. The first lateral wall 16B functions as a first abutment for the piston ring (FIG. 4), and the second lateral wall 16C functions as a second abutment for the piston ring 18 (FIGS. 1, 2, 3, and 3A). As clearly depicted in FIG. 3A, the piston ring is spaced from the bottom of the gully 16, such as to form an elastic seal on the internal wall of the cylinder 2 and to permit a passage of fluid through a passage F which places the gully 16 in fluid-dynamic communication with the first chamber 13 (and thus with the portion of the piston facing the first chamber 13).

The passage F is preferably realised on the bottom of the gully 16, and, in the described embodiment of the invention, comprises two radial holes F afforded in the bottom of the gully.

It should be noted that the fluid that reaches the gully originates both from the radial hole or holes F, though predominantly from the passage P realized between the internal surface of the cylinder, and the peripheral front surface of the free end of the piston. Both the annular passage P and the passage afforded by hole F place the first chamber in direct communication with the gully when the piston ring is in abutment against the second wall.

In an aspect of the present invention the second lateral wall 16C affords at least a depression 22 which enables a controlled bleeding of pressurized fluid between the piston ring 18 and the second lateral wall 16C when the piston ring is in abutment against the second wall.

By way of example, the depression 22 may be realized as a groove that extends radially with respect to the axis of the piston 7, for a length that is enough to place in communication the gap defined between the external surface of the piston 7 and the internal surface of the cylinder 2 with the gap defined between the piston ring 18 and the bottom wall 16A of the gully 16.

Figure 7:
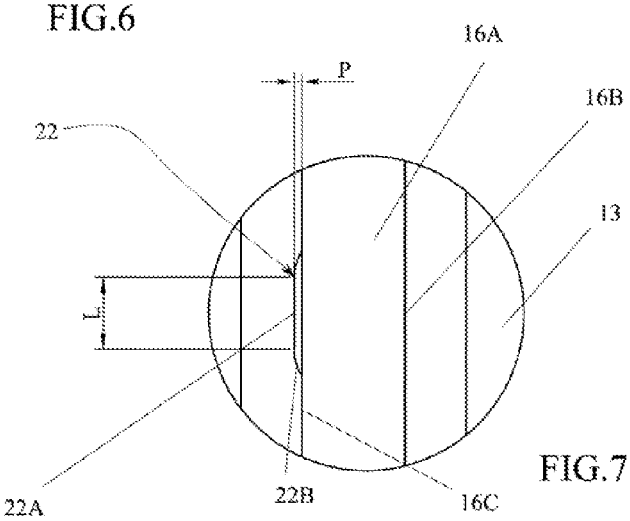
FIG. 7 is a larger-scale view of the detail shown in the circle of FIG. 5.

Advantageously the ratio between the useful depth P and useful width L of the depression (indicated approximately in FIG. 7) is less than 1 to 30. The depression is preferably realized using a circular milling cutter. The depression thus exhibits in transversal cross-section a straight bottom wall 22A connected to the lateral wall by two concave portions 22B (obviously it is also possible to include sharp corners, or other configurations). The useful depth is defined as the average depth of the depression. The useful width L of the depression is defined as the width of the average depth of the depression.

The operation of the invention is obvious for a technical expert on the basis of the above description, and is substantially as follows.

In FIG. 1 the chamber 14 is pressurised (and is thus supplied with fluid through the second hole 12). The piston 7 consequently moves towards the right in FIG. 1, towards the first head 3. The piston ring 18 slides on the internal surface of the cylinder 2 and thus comes into abutment against the second wall 16C of the gully 16. The fluid internally of the chamber 13 flows freely through the first hole 11.

When the piston ring 18 passes beyond the first hole 11 (FIG. 2) the fluid internally of the first chamber 13 can flow towards the first hole 11 only by passing through the gully 16 which it reaches principally through the passage P formed between the peripheral surface of the first end of the piston and the internal surface of the cylinder in which the piston slides and, to a lesser extent, through the hole F. The fluid thus bleeds through the depression 22, between the piston ring 18 (in abutment against the second wall) and the second lateral wall 16C of the gully.

Figure 2:
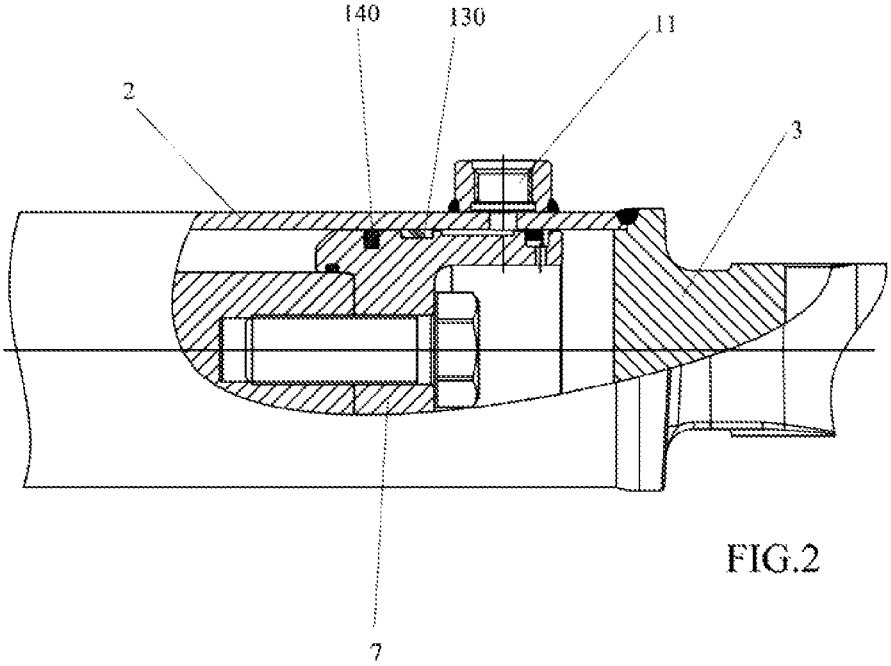
FIG. 2 is a partial view, partially sectioned, of the cylinder of FIG. 1, when the piston is in a deceleration step and proximal to the piston end-run position.

The fluid released in this way from the chamber 13 passes into an annular chamber 25 defined by the external surface of the piston, by the internal surface of the cylinder, by the main sealing ring 140, and by the piston ring 18. This annular chamber 25, as depicted in FIG. 2, comes into direct communication with the first hole 11, as soon as the piston ring 18 (which moves together with the piston) moves beyond the first hole 11.

Under these conditions and up until the piston reaches the end-run position (FIG. 3), in order to reach the first hole 11 the fluid present in the chamber 13 is obliged to pass through passages of minor cross-sectional dimensions (compared to the hole 11), resulting in significant load loss and generating resistance to the advance of the piston towards the first head 3. There is thus a substantial braking action on the piston stroke at parity of pressure present in the second chamber 14.

It has been observed that the predisposing of a depression 22 as described above considerably reduced the noise levels of a cylinder-piston group (compared to groups of conventional type), when the piston is in the deceleration step and is about to reach a first end-run position.

Indicatively, a reduction in noise was observed in the order of approximately 5 decibels compared to systems of like type to what is described in the U.S. Pat. No. 3,592,106.

It has been observed that the area of the cross-section of passage defined by the depression 22 determines the braking capacity of the piston (a greater passage area results in a less decisive braking effect).

It has further been observed that the reduction in noise levels is linked to the ratio between the useful depth P of the depression and the useful width L of the depression. Preferable values for noise reduction are achieved at ratios of less than 1 to 30.

When the first free end 15 of the piston is in contact with the first head 3, the piston is at the first end-run position.

If it is required to move the piston away from the first end-run position, and consequently towards the left in FIG. 1, outflow of the pressurized fluid is enabled from the second hole 12, and pressurized fluid is supplied into the first hole 11.

Figure 3A:
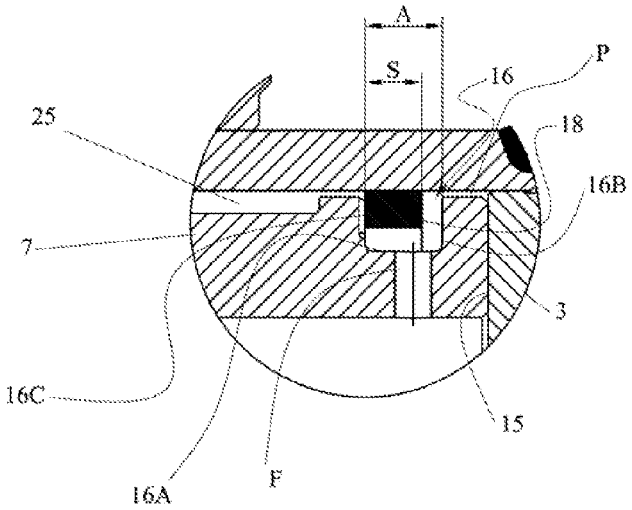
FIG. 3A is an enlarged detail of the area enclosed within the circle of FIG. 3.

In these conditions and starting from the condition depicted in FIG. 3A, the annular chamber 25 is pressurized and the piston ring 18 moves immediately against the first wall 16B of the gully 16. At this point the pressurized fluid flows through the passages F to reach the first chamber 13 and so the piston begins moving towards the right in FIG. 1.

Obviously other embodiments of the invention are possible in addition to the one described.

It is possible to provide a single hole F of suitable area, placing the gully 16 in communication with the first chamber 13.

Obviously, in place of a single depression 22, a plurality of depressions could be provided, always realized on the second wall 16C of the gully 16. In this case the cylinder braking capacity is determined by the sum of the passage sections (depth×length) of all the depressions.

In an embodiment of the invention that is not illustrated, three depressions could be provided on the second lateral wall, angularly arranged at intervals of 120°.

In a further alternative embodiment of the invention a system alike to the system described herein above could be provided in proximity of a second free end 30 of the piston. In this case a further gully would be formed within which a further piston ring is movable. At least a further passage would be provided, placing the gully in communication with the second chamber and obviously at least a further depression, all designed in an entirely alike manner to what has already been described herein above.

Figure 8:
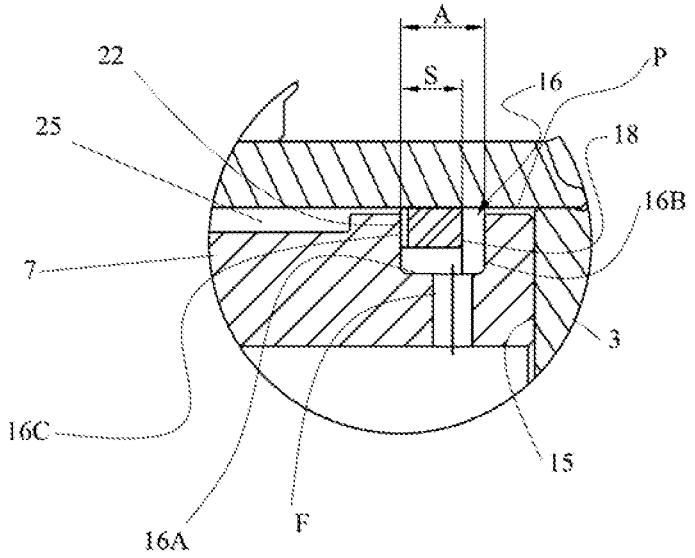
FIG. 8 is a larger-scale view of a detail of an alternative embodiment of the invention.

As can be deduced from the operation of the invention, the depression provided on the second lateral wall of the gully can be realized alternatively (as in FIG. 8), or additionally, also on the wall of the piston ring configured to abut against the second lateral wall. The depression realized on the ring preferably exhibits the same characteristics and conformation as described herein above. It should be noted that in FIG. 8 the same numerical references have been used as previously in denoting similar functional parts, which are therefore not described again.

Substantially, it is sufficient that the depression is realized on the contact surface between the second lateral wall of the gully and the piston ring.

It is also possible to provide a ring in which both the walls configured to abut against the lateral walls of the gully exhibit a depression.

A plurality of embodiments of the present invention are described herein above, but further embodiments could be conceived exploiting the same innovative concept.

The invention claimed is:

1. A hydraulic piston-cylinder group comprising a cylinder closed by a first and a second head, a piston being sealedly slidable internally of the cylinder, said piston is fixed to a rod extending through a hole provided in at least one of the first and second heads, the piston defining internally of the cylinder at least a first and second chamber respectively in communication with a first and a second inlet/outlet hole of a pressurized fluid for actuating the piston in movement between a first and a second end-run position, the piston providing, proximal to at least a first free end thereof facing the first chamber, a gully in which a piston ring is positioned, the ring being axially movable within the gully, the gully being defined by a bottom wall, a first lateral wall proximal to the first free end and a second lateral wall distal of the first free end, the first and second lateral walls providing respectively a first and a second abutment for the piston ring, the gully being in communication through at least a passage with the first chamber, wherein on the contact surface between the second lateral wall of the gully and the piston ring at least one depression is provided that enables a controlled bleeding of pressurized fluid between the piston ring and the second lateral wall when the piston ring abuts against the second lateral wall.

2. The group of claim 1, wherein the at least one depression is realized on the second lateral wall of the gully.

3. The group of claim 1, wherein the at least one depression is realized on the wall of the piston ring configured to abut against the second lateral wall of the gully.

4. The group of claim 3, wherein at least a further depression is provided on the wall of the piston ring configured to abut against the first wall of the gully.

5. The group of claim 1, wherein the passage is realized on the bottom of the gully.

6. The group of claim 1, wherein the passage is formed between an external surface of the first free end of the piston and an internal surface of the cylinder.

7. The group of claim 1, wherein a ratio between a depth and a width of the depression is less than 1 to 30.

8. The group of claim 1, wherein a plurality of depressions are provided on the second lateral wall and/or on the surface of the ring configured to abut against the second and/or first lateral walls.

9. The group of claim 1, wherein the gully is located between the first free end of the piston and a sealing ring.

* * * * *